US008698074B2

(12) United States Patent
Itoi et al.

(10) Patent No.: US 8,698,074 B2
(45) Date of Patent: Apr. 15, 2014

(54) MS/MS MASS SPECTROMETER

(75) Inventors: Hiroto Itoi, Kyoto (JP); Daisuke Okumura, Nagaokakyo (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/455,228

(22) Filed: Apr. 25, 2012

(65) Prior Publication Data

US 2012/0205536 A1 Aug. 16, 2012

Related U.S. Application Data

(63) Continuation of application No. 12/678,452, filed on Mar. 16, 2010, now Pat. No. 8,242,437.

(51) Int. Cl.
*H01J 49/04* (2006.01)

(52) U.S. Cl.
USPC ..... 250/289; 250/281; 250/288

(58) Field of Classification Search
USPC ..... 250/281, 282, 288, 289
See application file for complete search history.

(56) References Cited

U.S. PATENT DOCUMENTS

| | | | | |
|---|---|---|---|---|
| 5,049,739 | A * | 9/1991 | Okamoto | 250/281 |
| 5,349,186 | A * | 9/1994 | Ikonomou et al. | 250/288 |
| 5,847,386 | A | 12/1998 | Thomson et al. | |
| 6,525,314 | B1 * | 2/2003 | Jarrell et al. | 250/297 |
| 6,534,764 | B1 * | 3/2003 | Verentchikov et al. | 250/287 |
| 6,781,117 | B1 | 8/2004 | Willoughby et al. | |
| 6,812,453 | B2 | 11/2004 | Bateman et al. | |
| 7,034,292 | B1 * | 4/2006 | Whitehouse et al. | 250/289 |
| 2004/0026612 | A1 | 2/2004 | Bateman et al. | |
| 2004/0056189 | A1 | 3/2004 | Tanner et al. | |
| 2004/0222369 | A1 | 11/2004 | Makarov et al. | |
| 2004/0251411 | A1 | 12/2004 | Bateman et al. | |
| 2006/0192104 | A1 | 8/2006 | Schultz et al. | |
| 2007/0138386 | A1 * | 6/2007 | Makarov et al. | 250/288 |

(Continued)

FOREIGN PATENT DOCUMENTS

| | | | |
|---|---|---|---|
| JP | 05-159741 | A | 6/1993 |
| JP | 07-201304 | A | 8/1995 |

(Continued)

OTHER PUBLICATIONS

Japanese Office Action dated Nov. 29, 2011, issued in corresponding Japanese Patent Application No. 2009-532961.

(Continued)

*Primary Examiner* — David A Vanore
*Assistant Examiner* — Wyatt Stoffa
(74) *Attorney, Agent, or Firm* — Sughrue Mion, PLLC

(57) ABSTRACT

The gas conductance on the ion injection side of a collision cell is made larger than the gas conductance on the ion exit side by providing two ion injection apertures 23, 25 in the collision cell. Due to the different gas conductances, a CID gas supplied through the gas supply tube 31 generally flows in a direction from the ion injection side to the ion exit side in the collision cell, namely, in the ion's passage direction. When the ions injected in the collision cell 20 slow down upon contacting with the CID gas, their progress is assisted by the gas flow, so that the delay of the ions in the collision cell 20 is alleviated. As a result, it is possible to avoid a deterioration in the detection sensitivity of a target product ion and to prevent a ghost peak caused by the stay of the ions.

2 Claims, 6 Drawing Sheets

(56) References Cited

U.S. PATENT DOCUMENTS

| | | | | |
|---|---|---|---|---|
| 2008/0265154 | A1 | 10/2008 | Cousins et al. | |
| 2009/0065692 | A1 | 3/2009 | Javahery et al. | |
| 2010/0012835 | A1* | 1/2010 | Okumura et al. | 250/288 |
| 2010/0065733 | A1* | 3/2010 | Bateman et al. | 250/282 |
| 2010/0072360 | A1 | 3/2010 | Green et al. | |
| 2010/0288922 | A1* | 11/2010 | Itoi et al. | 250/289 |
| 2012/0056084 | A1* | 3/2012 | Giles | 250/282 |

FOREIGN PATENT DOCUMENTS

| | | | |
|---|---|---|---|
| JP | 08-124519 | A | 5/1996 |
| JP | 11-510946 | A | 9/1999 |
| JP | 2003-525515 | A | 8/2003 |
| JP | 2004-507875 | A | 3/2004 |
| WO | 97/07530 | A | 2/1997 |
| WO | 00/77823 | A2 | 12/2000 |
| WO | 02/19382 | A2 | 3/2002 |

OTHER PUBLICATIONS

Extended European Search Report issued in corresponding European Patent Application No. 07827791.0 dated Jun. 6, 2013.

* cited by examiner

MS/MS MASS SPECTROMETER

CROSS-REFERENCE TO RELATED PATENT APPLICATIONS

This is a Continuation Application of application Ser. No. 12/678,452, filed Mar. 16, 2010, which is the National Stage of International Application No. PCT/JP2007/001010, filed Sep. 18, 2007, the disclosures of which are incorporated herein in their entirety by reference.

TECHNICAL FIELD

The present invention relates to an MS/MS mass spectrometer for dissociating an ion having a specific mass-to-charge ratio by a collision-induced dissociation (CID) and mass analyzing the product ion (or fragment ion) generated by this process.

BACKGROUND ART

A well-known mass-analyzing method for identifying a substance having a large molecular weight and for analyzing its structure is an MS/MS analysis (or tandem analysis). FIG. 14 is a schematic configuration diagram of a general MS/MS mass spectrometer disclosed in Patent Documents 1 and 2 and other documents.

In this MS/MS mass spectrometer, three-stage quadrupole electrodes 12, 13, and 15 each composed of four rod electrodes are provided, inside the analysis chamber 10 which is vacuum-evacuated, between an ion source 11 for ionizing a sample to be analyzed and a detector 16 for detecting an ion and providing a detection signal in accordance with the amount of ions. A voltage$\pm(U1+V1\cdot\cos\cdot\omega t)$ is applied to the first-stage quadrupole electrodes 12, in which a direct current (DC) U1 and a radio-frequency (RF) voltage $V1\cdot\cos\omega t$ are synthesized. Due to the effect of the electric field generated by this application, only a target ion having a specific mass-to-charge ratio m/z is selected as a precursor ion from among a variety of ions generated in the ion source 11 and passes through the first-stage quadrupole electrodes 12.

The second-stage quadrupole electrodes 13 are placed in the tightly sealed collision cell 14, and Ar gas for example as a CID gas is introduced into the collision cell 14. The precursor ion sent into the second-stage quadrupole electrodes 13 from the first-stage quadrupole electrodes 12 collides with the Ar gas inside the collision cell 14 and is dissociated by the collision-induced dissociation to produce a product ion. Since this dissociation has a variety of modes, two or more kinds of product ions with different mass-to-charge ratios are generally produced from one kind of precursor ion, and these product ions exit from the collision cell 14 and are introduced into the third-stage quadrupole electrodes 15. Since not every precursor ion is dissociated, some non-dissociated precursor ions may be directly sent into the third-stage quadrupole electrodes 15.

To the third-stage quadrupole electrodes 15, a voltage$\pm(U3+V3\cdot\cos\omega t)$ is applied in which a direct current (DC) U3 and a radio-frequency (RF) voltage $V3\cdot\cos\omega t$ are synthesized. Due to the effect of the electric field generated by this application, only a product ion having a specific mass-to-charge ratio is selected, passes through the third-stage quadrupole electrodes 15, and reaches the detector 16. The DC U3 and RF voltage $V3\cdot\cos\omega t$ which are applied to the third-stage quadrupole electrodes 15 are appropriately changed, so that the mass-to-charge ratio of an ion capable of passing the third-stage quadrupole electrodes 15 is scanned to obtain the mass spectrum of the product ions generated by the dissociation of the target ion.

In a conventional and general MS/MS mass spectrometer, the dimension of the collision cell 14 along the ion optical axis C which is the central axis of the ion stream is set to be approximately 150 through 200 mm. In addition, the supply of the CID gas is controlled so that the gas pressure in the collision cell 14 is a few mTorr. When, under such conditions, ions travel a radio-frequency electric field in the atmosphere of such a comparatively high gas pressure, the kinetic energy of the ions attenuates due to collisions with the gas, thereby the ions slow down. Since, in the collision cell 14 of the aforementioned conventional MS/MS mass spectrometer, the area where the ion are decelerated is long, the delay of the ions becomes significant, and some ions may even halt.

In the case where an MS/MS mass spectrometer is used as a detector of a chromatograph such as a liquid chromatograph for example, it is necessary to repeatedly perform an analysis at predetermined time intervals. If the delay of the ions is significant as previously described, ions that should normally pass through the third-stage quadrupole electrodes 15 may not be able to pass through it, which deteriorates the detection sensitivity. In addition, ions remaining in the collision cell 14 may come out at a timing when no ion should appear, which creates a ghost peak. Moreover, since it takes a longer time for an ion to reach the detector 16, the time interval of the repeated analysis needs to be determined taking such a situation into account, which may bring about a detection loss in a multi-component analysis.

In order to avoid such problems as previously described, conventionally and generally, a direct current (DC) electric field having a potential gradient in the direction of an ion passage is formed in the collision cell 14, so that an ion is accelerated by the effect of the DC electric field.

Patent Document 3 discloses a mass spectrometer in which an electric field having a potential gradient in the direction of the ion optical axis is formed to accelerate ions by applying a DC voltage to a radio-frequency ion guide inclined to the ion optical axis or by applying a different DC voltage to each of the rods dividedly placed in the direction of the ion optical axis, so that ions are accelerated. Patent Document 4 discloses a mass spectrometer in which ions are accelerated by successively applying pulse voltages to the aperture electrodes of a radio-frequency ion guide composed of about one hundred aperture plates arranged in the direction of the ion optical axis.

However, when the rod electrodes of a radio-frequency ion guide are inclined or deformed, or when an auxiliary electrode is used in order to form a DC electric field having a potential gradient in the direction of the ion optical axis, the radio-frequency electric field adequately designed for converging ions may be disturbed, and the ion transmission efficiency may be deteriorated. On the other hand, the mass spectrometer having the structure according to Patent Document 4 is difficult to control due to its complex structure and necessity to appropriately control the pulse voltages for accelerating ions in accordance with each mass-to-charge ratio.

[Patent Document 1] Japanese Unexamined Patent Application Publication No. H07-201304

[Patent Document 2] Japanese Unexamined Patent Application Publication No. H08-124519

[Patent Document 3] U.S. Pat. No. 5,847,386

[Patent Document 4] U.S. Pat. No. 6,812,453

DISCLOSURE OF THE INVENTION

Problems to be Solved by the Invention

The present invention has been achieved to solve the aforementioned problems, and the main objective thereof is to provide an MS/MS mass spectrometer free from a deterioration in the detection sensitivity and the emergence of a ghost peak in a chromatogram by preventing the stay of ions in a collision cell with a simple structure.

Means for Solving the Problems

A first aspect of the present invention which has been made to solve the foregoing problems is an MS/MS mass spectrometer including, in a vacuum chamber: a first mass separation unit for selecting ions having a specific mass-to-charge ratio as precursor ions from among various species of ions; a collision cell for dissociating the precursor ions by making the precursor ions collide with a collision-induced dissociation (CID) gas; and a second mass separation unit for selecting ions having a specific mass-to-charge ratio from among various species of product ions generated by the dissociation, wherein the gas conductance on a side of an injection end face of the collision cell having an ion injection aperture for injecting ions into the collision cell is made smaller than the gas conductance on a side of an exit end face of the collision cell having an ion exit aperture for discharging ions from the collision cell so as to produce, in the collision cell, a flow of the CID gas having a component of flow vector in the same direction as the passage direction of the ions injected through the ion injection aperture.

A variety of configurations and structures may be listed for making the gas conductance on the side of the injection end face smaller than the gas conductance on the side of the exit end face. Namely, in one embodiment of the MS/MS mass spectrometer according to the first invention, the area of the ion injection aperture is smaller than the area of the ion exit aperture.

In another embodiment of the MS/MS mass spectrometer according to the first invention, a plurality of the ion injection apertures are provided along the direction of the ion passage.

In yet another embodiment, a gas passage aperture through which the CID gas is discharged from the collision cell is provided on the side of the exit end face of the collision cell in addition to the ion exit aperture.

A second aspect of the present invention which has been made to solve the foregoing problems is an MS/MS mass spectrometer including, in a vacuum chamber: a first mass separation unit for selecting ions having a specific mass-to-charge ratio as precursor ions from among various species of ions; a collision cell for dissociating the precursor ions by making the precursor ions collide with a CID gas; and a second mass separation unit for selecting ions having a specific mass-to-charge ratio from among various species of product ions generated by the dissociation, wherein the orientation of a discharge port of a gas channel for supplying the CID gas into the collision cell is directed from the side of an injection end face of the collision cell having an ion injection aperture for injecting ions into the collision cell to the side of an exit end face of the collision cell having an ion exit aperture for discharging ions from the collision cell so as to produce, in the collision cell, a flow of the CID gas having a component of flow vector in the same direction as the passage direction of the ions injected through the ion injection aperture.

A combined structure of the first and second aspects of the present invention may of course be employed.

Effect of the Invention

In the MS/MS mass spectrometer according to the first and second aspects of the present, a flow of the CID gas from the ion injection aperture to the ion exit aperture is generated in the collision cell; this gas flow promotes transportation of the ions by carrying or pushing the ions. Therefore, even in the case where the ions lose kinetic energy thereof upon contact with the CID gas, progress of the precursor ion or the product ions produced by the dissociation are promoted so that a substantial delay in the progress of the ions can be avoided in the collision cell. As a result, it is possible to increase the amount of target ions to be selected in the second mass separation unit in a subsequent stage and is thus possible to improve the detection sensitivity. Further, since the stay of the ions in the collision cell can be avoided, it is possible to prevent the emergence of a ghost peak in a mass spectrum.

Moreover, since an electrode with a simple structure such as a simple rod electrode may be used as an ion optical component which configures the ion guide disposed inside the collision cell, the manufacturing, assembly, alignment, and other production processes are simple, and thus the cost can be reduced. Furthermore, as neither a voltage generation circuit for accelerating ions nor a control circuit for such voltage application is necessary, the cost can be reduced in this respect too. In addition, the ion guide as described earlier can form an optimal radio-frequency electrical field, and therefore deterioration in the ion transmission ratio due to scattering of ions can be prevented.

EXPLANATION OF NUMERALS

10 . . . Analysis Chamber
11 . . . Ion Source
12 . . . First-Stage Quadrupole Electrodes
15 . . . Third-Stage Quadrupole Electrodes
16 . . . Detector
20 . . . Collision Cell
21 . . . Ion Guide
22 . . . First Injection Wall Surface
23 . . . First Ion Injection Aperture
24 . . . Second Injection Wall Surface
25 . . . Second Ion Injection Aperture
26 . . . Exit Wall Surface
27 . . . Ion Exit Aperture
30 . . . CID Gas Supplier
31 . . . Gas Supply Tube
32 . . . Valve

BEST MODES FOR CARRYING OUT THE INVENTION

Figure 1:
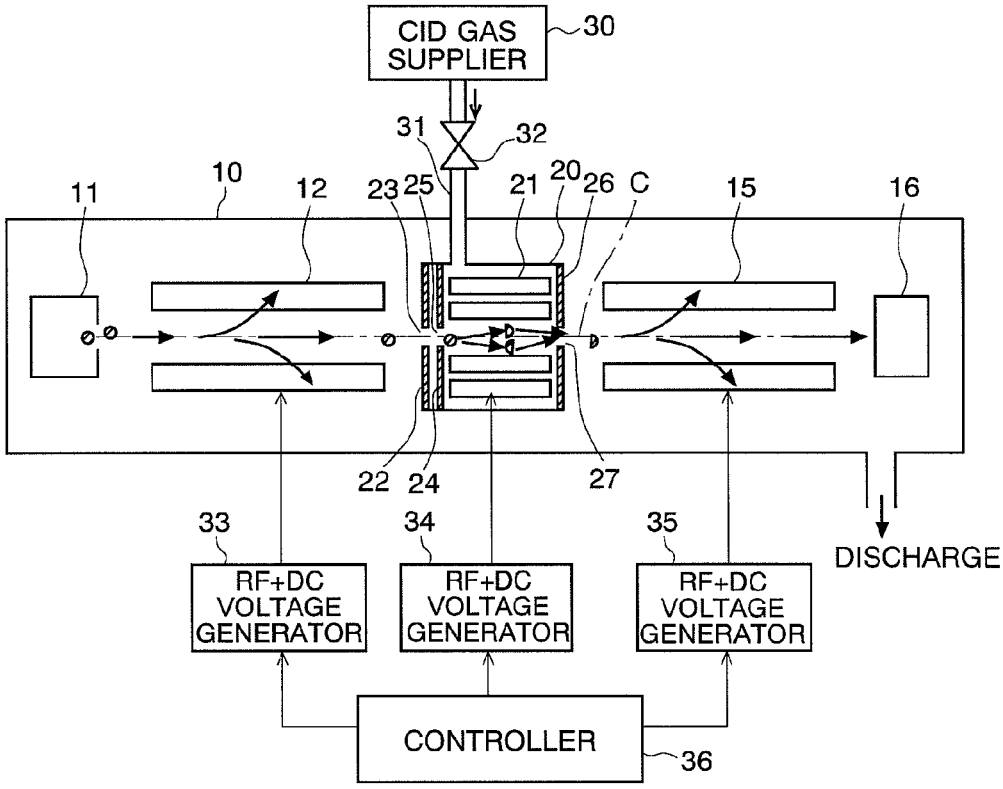
FIG. 1 is a schematic overall configuration diagram of an MS/MS mass spectrometer according to one embodiment of the present invention.
Figure 2:
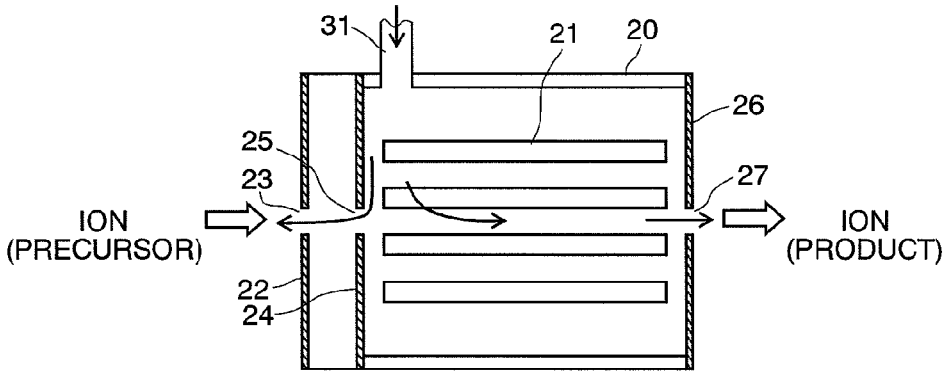
FIG. 2 is a schematic sectional view of a collision cell in the MS/MS mass spectrometer of the first embodiment.
Figure 14:
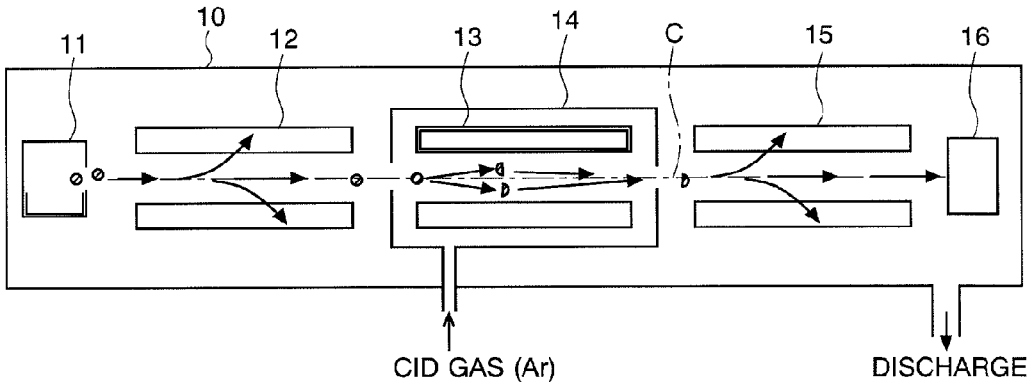
Fig. 14 (Prior Art)
FIG. 14 is an overall configuration diagram of a conventional MS/MS mass spectrometer.

An MS/MS mass spectrometer which is one embodiment of the present invention will be described with reference to the attached drawings. FIG. 1 is an overall configuration diagram of the MS/MS mass spectrometer according to the present embodiment, and FIG. 2 is a detailed sectional view of a collision cell in the MS/MS mass spectrometer of the present embodiment. The same components as in the conventional configuration illustrated in FIG. 14 are indicated with the same numerals, and therefore detailed explanations are omitted.

In the MS/MS mass spectrometer of the present embodiment, as in a conventional configuration, a collision cell 20 is provided between a first-stage quadrupole electrode 12 (corresponding to the first mass separation unit in the present invention) and a third-stage quadrupole electrode 15 (corresponding to the second mass separation unit in the present invention) in order to generate various species of product ions by dissociating precursor ions. As illustrated in FIG. 2, the collision cell 20 has a substantially hermetically-closed structure except for ion injection apertures 23, 25 and an ion exit aperture 27, with its peripheral face formed into a substantially cylindrical shape and with both of its end faces almost sealed. Inside the collision cell 20 is provided an ion guide 21 in which eight cylindrical rod electrodes are arranged in parallel with one another in a manner to surround an ion optical axis C.

The ion injection side (left side end face in FIG. 2) of the collision cell 20 has a double-walled structure in which a first injection wall surface 22 perforated with the first ion injection aperture 23 having a predetermined diameter (e.g. $\phi$1.6 mm) and a second injection wall surface 24 perforated with the second ion injection aperture 25 having the same diameter (e.g. $\phi$1.6 mm) are disposed with a predetermined distance therebetween in the direction of the ion optical axis C. On the other hand, the ion exit side has only a single exit wall surface 26 perforated with the ion exit aperture 27 having the same diameter (e.g. $\phi$1.6 mm).

Upon opening a valve 32 provided on a gas supply tube 31 which connects a CID gas supplier 30 with the collision cell 20, a CID gas such as Ar gas is supplied from the CID gas supplier 30 to the collision cell 20. Pressures for the supply are adjustable by controlling the CID gas supplier 30. The supply of the CID gas makes the gas pressure inside the collision cell 20 higher than the pressure of the gas surrounding the collision cell inside an analysis chamber 10. Due to the difference in the pressure between the inside and outside of the collision cell, the CID gas flows from the collision cell 20 to the analysis chamber 10 through the ion injection apertures 23, 25 and the ion exit apertures 27. The flow rates of the CID gas passing through the ion injection apertures 23, 25 and the ion exit aperture 27 depend on the gas conductance of the respective apertures.

Figure 4:
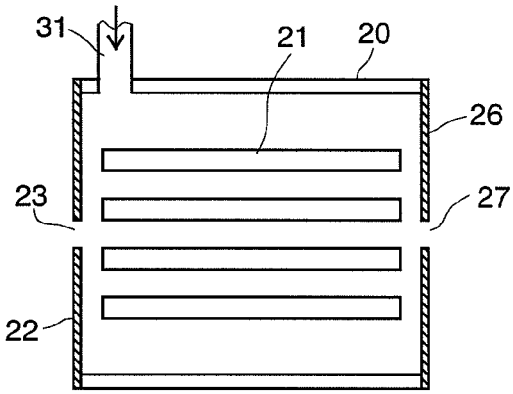
Fig. 4 (Prior Art)
FIG. 4 is a schematic sectional view of a conventional collision cell.

In case of a conventional structure as shown in FIG. 4, the gas conductance at the ion injection aperture 23 is almost the same as the gas conductance at the ion exit aperture 27, and thus the flow rates of the gas from the collision cell 20 are almost the same between them. On the other hand, according to the present embodiment, the double-walled structure of the ion injection side of the collision cell 20 has a smaller gas conductance since this structure is equivalent to a pair of series-connected flow resistances determined by the diameters of the ion injection apertures 23, 25 in the injection wall surfaces 22, 24, respectively. Namely, the gas conductance of the ion injection aperture combining the first injection aperture 23 and the second ion injection aperture 25 is smaller than the gas conductance of the ion exit aperture 27, and thus the CID gas is not easily discharged here. For this reason, a flow of the CID gas is generated from the side of the second injection aperture 25 to the ion exit aperture 27 in the whole collision cell 20 as shown in FIG. 2.

Under control of a controller 36, to the first-stage quadrupole electrodes 12, the first RF (radio-frequency)+DC (direct current) voltage generator 33 applies a voltage$\pm$(U1+V1·cos $\omega$t) in which a DC voltage U1 and a radio-frequency voltage V1·cos $\omega$t are synthesized or a voltage$\pm$(U1+V1·cos $\omega$t)+Vbias1 in which a predetermined DC bias voltage Vbias1 is further added. To the third-stage quadrupole electrodes 15, the third RF+DC voltage generator 35 applies a voltage$\pm$(U3+V3·cos $\omega$t) in which a DC voltage U3 and a radio-frequency voltage V3·cos $\omega$t are synthesized, or a voltage$\pm$(U3+V3·cos $\omega$t)+Vbias3 in which a predetermined DC bias voltage Vbias3 is further added. These voltage settings are performed in the same manner as before. For the eight rod electrodes which constitute the ion guides 21, four alternate electrodes in the circumferential direction centering on the ion optical axis C are considered to be a single group. For the two groups of electrodes, the second RF+DC voltage generator 34 applies a voltage U2+V2·cos $\omega$t to one group, in which a DC bias voltage U2 and a radio-frequency voltage V2·cos $\omega$t are synthesized. The second RF+DC voltage generator 34 also applies a voltage U2−V2·cos $\omega$t to the other group, in which the applied voltage is obtained by synthesizing the DC bias voltage U2 and a radio-frequency voltage −V2·cos $\omega$t which has a reversed polarity to the radio-frequency voltage V2·cos $\omega$t.

The precursor ions selected in the electric field generated by the first-stage quadrupole electrodes 12 enter the collision cell 20 through the ion injection apertures 23, 25. Preferably, the passing efficiency of the ions passing through the first ion injection aperture 23 and the second ion injection aperture 25 may be promoted by applying an appropriate amount of DC voltage to each of the two plates of the first injection wall surface 22 and the second injection wall surface 24 so as to allow them to function as an optical lens for converging ions. A radio-frequency electric field is formed in the collision cell 20 by the ion guide 21 as described earlier, and ions are trapped by the effect of the radio-frequency electric field. The precursor ions collide with the CID gas, and a bond or bonds within the precursor ions are cut due to the collision energy so that dissociation of the ions occurs. As the dissociation can take place in various forms, dissociating one species of precursor ion does not always produce one species of product ion. Although kinetic energy originally possessed by the precursor ion is partly lost in the collision with the CID gas, the progress of the precursor ion or the product ions is promoted with the help of the previously described gas flow moving in the same direction as the passage direction of the injected ions within the collision cell. Thus, the ions move smoothly toward the ion exit aperture 27 without staying inside the collision cell 20, and then are discharged from the collision cell 20 through the ion exit aperture 27.

As previously described, the MS/MS mass spectrometer according to the examples of the present embodiment can prevent the delay or stay of ions in the collision cell by the action of the gas flow purposely generated in the collision cell 20. Therefore, the target product ion derived from the precursor ion can be introduced to the third quadrupole electrode 15 and mass-separated therein without significant delay. As a result, a large amount of the product ion can be transferred to the detector 16, allowing achievement of high detection sensitivity. Further, since the ions are prevented from being retained in the collision cell 20, no ghost peak will appear on the mass spectrum.

Figure 3:
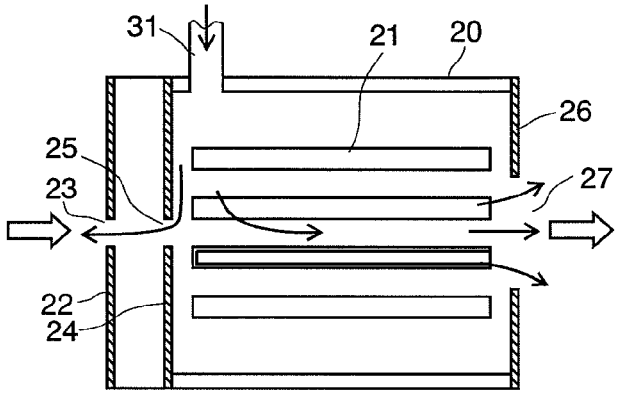
FIG. 3 is a schematic sectional view of a modified example of a collision cell in the MS/MS mass spectrometer of the first embodiment.
Figure 5:
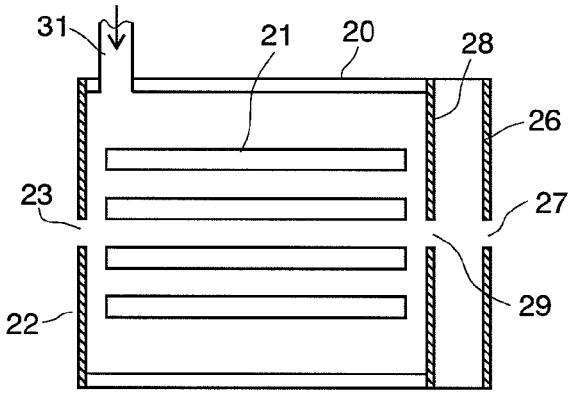
FIG. 5 is a schematic sectional view of a collision cell for comparison.
Figure 6:
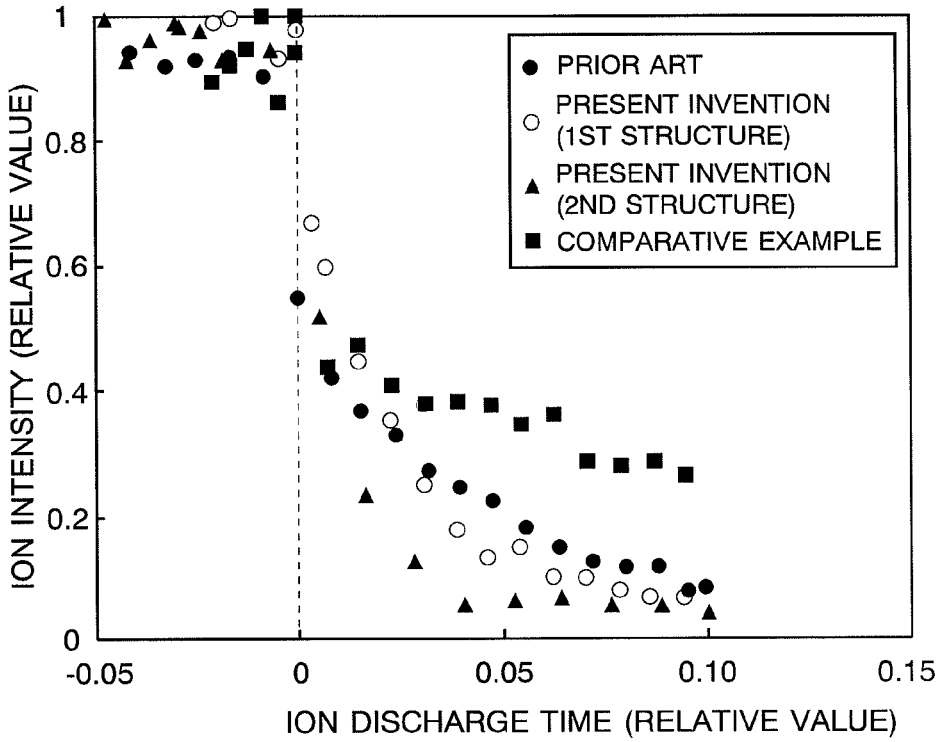
FIG. 6 is a graph showing the result of an actual measurement for determining the relationship between an ion discharge time and a relative strength in the four collision cells shown in FIGS. 2 to 5.

The following description will discuss the test conducted to confirm the ability to reduce the delay of ions of the collision cells 20 used in the examples of the present embodiment. The ion discharge rate was examined for four types of collision cells having different structures with each other including: a configuration of the example shown in FIG. 2; a modified configuration of the example shown in FIG. 3, in which the gas conductance was further increased by enlarging the diameter of the ion exit aperture 27 to ϕ2 mm; a conventional configuration shown in FIG. 4; and a configuration in which the exit side has a double-walled structure shown in FIG. 5. FIG. 6 is a graph showing changes in the intensity of the detected product ion derived from the precursor ion obtained by an actual measurement of the intensity after the precursor ion was continuously injected in the collision cell 20 until time (t)=0 when the injection was stopped. A faster reduction in the detection intensity indicates a smaller delay of ions.

Figure 7:
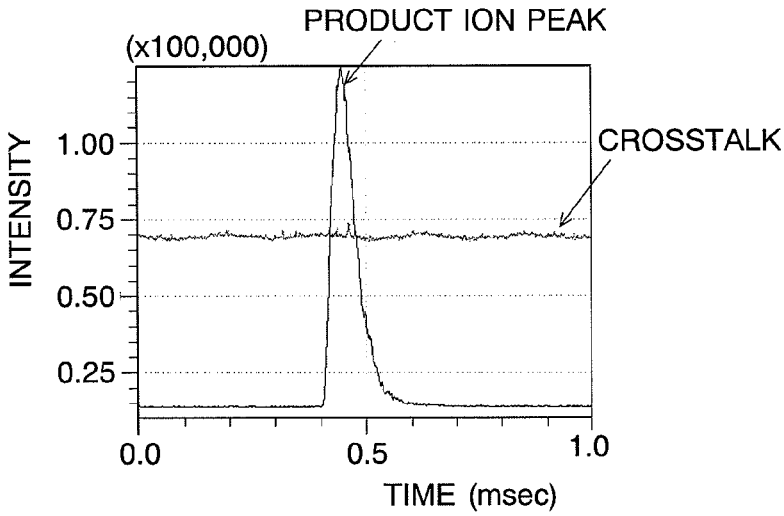
FIG. 7 is a diagram illustrating mass chromatograms which are the results of research on the delay of a precursor ion in a collision cell.

FIG. 6 proves that ions are discharged faster in the collision cell having the configuration of the present embodiment shown in FIG. 2 than in the collision cell having the conventional configuration shown in FIG. 4. It also shows that ions are discharged much faster in the collision cell having the configuration of the modified example shown in FIG. 3, thus confirming that this configuration is effective in preventing the delay of the ions. FIG. 7 is a diagram which illustrates mass chromatograms obtained in the modified example shown in FIG. 3 by detection of a product ion having mass-to-charge ratio of 202 derived from papaverine having mass-to-charge ratio of 340 as a precursor ion and also illustrates results of detection of crosstalk after a lapse of 6.5 milliseconds. The crosstalk level is only 0.01% relative to the peak intensity of the product ion, and this is practically a sufficiently small value. Those results prove as well that the exit of the product ion from the collision cell 20 has been completed at 6.5 milliseconds after the injection of the precursor ion to the collision cell 20 was discontinued.

In the above example, the gas conductance on the ion injection side is made smaller than the gas conductance on the ion exit side by allowing the injection wall surface on the ion injection side to have a double-walled structure provided with the two ion injection apertures 23, 25. In the modified example, the aperture area of the ion exit aperture 27 is further increased so as to create a larger difference in the gas conductance. The number of ion injection apertures is of course not limited to two and may be three or more. Other configurations may be employed to allow the gas conductance on the ion injection side to be smaller than the gas conductance on the ion exit side.

Figure 8:
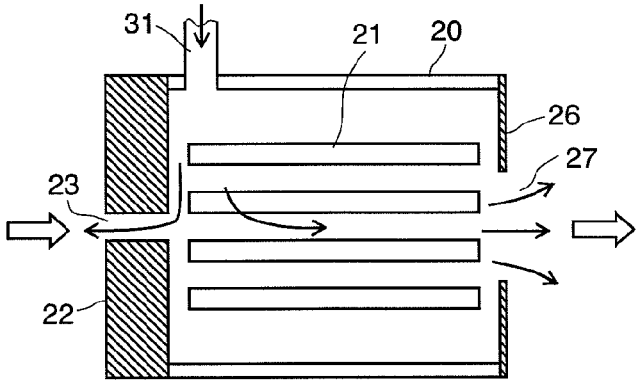
FIG. 8 is a schematic sectional view of a collision cell according to one of the other embodiments.

FIG. 8 illustrates an example of a configuration in which the thickness of the injection wall surface 22 is increased to reduce the gas conductance instead of providing a plurality of injection apertures.

Figure 9:
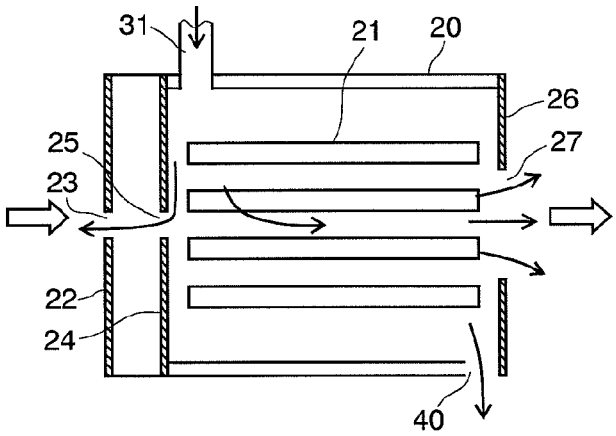
FIG. 9 is a schematic sectional view of a collision cell according to one of the other embodiments.
Figure 10:
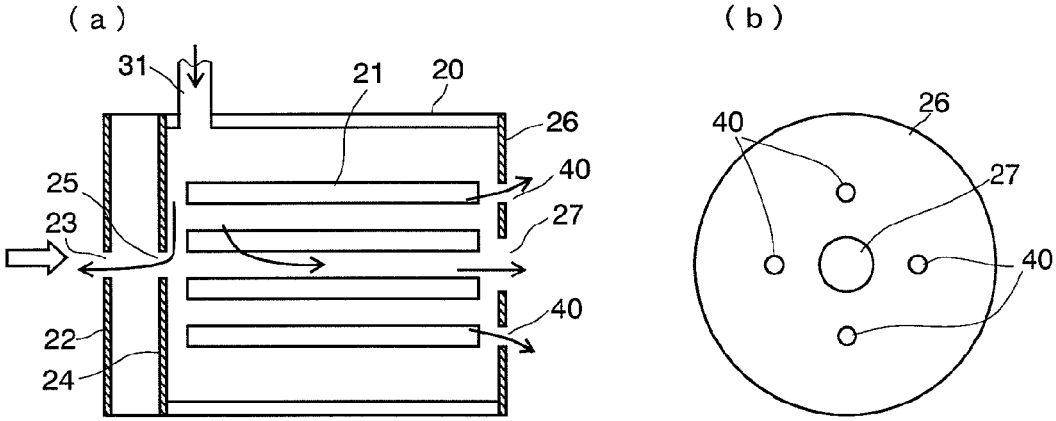
FIG. 10 is a schematic sectional view of a collision cell according to one of the other embodiments.

Other possible configurations include a configuration in which an aperture other than the ion exit aperture 27 is provided for flowing a CID gas from inside the collision cell into the analysis chamber 10. FIG. 9 illustrates an example in which a gas passage outlet 40 is additionally provided on the ion exit side at a site other than the exit end face 26. FIG. 10 illustrates an example in which gas passage outlets 40 are additionally provided on the ion exit side at positions different from the ion optical axis on the exit end face 26.

Figure 11:
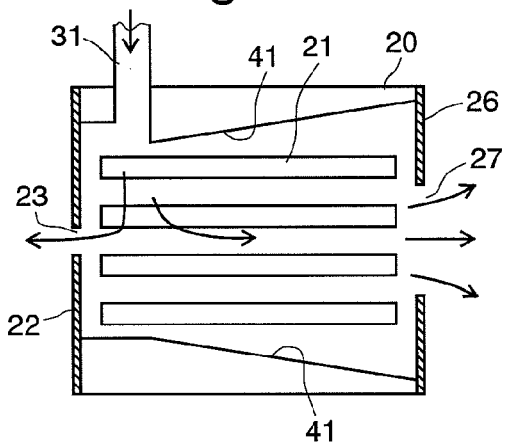
FIG. 11 is a schematic sectional view of a collision cell according to one of the other embodiments.

As shown in FIG. 11, an inner surface 41 surrounding the ion guide 21 may have a truncated cone shape in the collision cell 20 so that the gas conductance inside the collision cell 20 is also varied between the ion injection side and the ion exit side.

Figure 12:
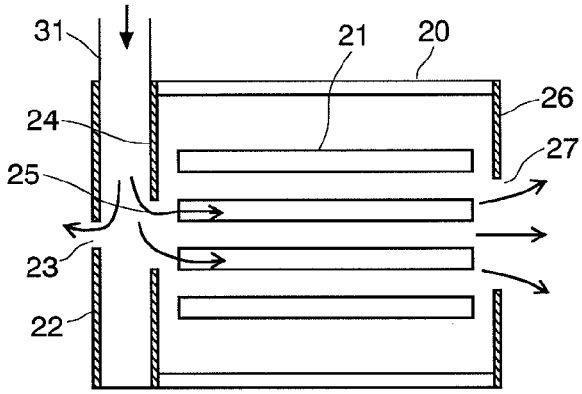
FIG. 12 is a schematic sectional view of a collision cell according to one of the other embodiments.

In an example shown in FIG. 12, a connection point of the gas supply tube 31 for introducing a CID gas is located between the first injection wall surface 22 and the second injection wall surface 24. Moreover, the aperture area of the second ion injection aperture 25 is made larger than the aperture area of the first ion injection aperture 23. As a result, the flow of a CID gas into the collision cell 20 is directed from the ion injection side to the ion exit side so that the flow of the gas is further accelerated in addition to the foregoing action derived from the difference in the gas conductance.

Figure 13:
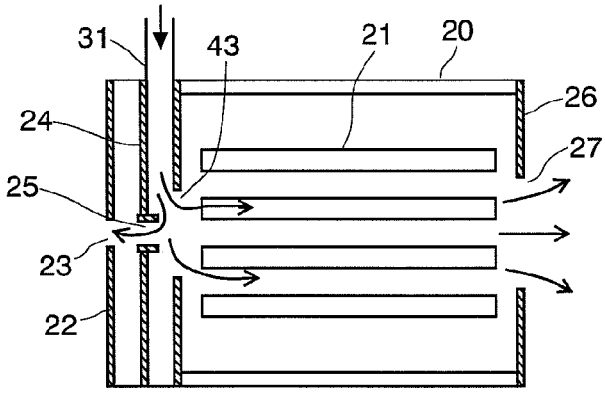
FIG. 13 is a schematic sectional view of a collision cell according to one of the other embodiments.

FIG. 13 also shows an example in which the direction of the flow of a CID gas is similarly directed from the ion injection side to the ion exit side. This configuration further reduces the gas conductance on the ion injection side to further accelerate the gas flow.

It should be noted that every embodiment and modification described thus far is an example of the present invention, and therefore any modification, adjustment, or addition other than the aforementioned description appropriately made within the spirit of the present invention is also covered by the claims of the present patent application.

The invention claimed is:

1. An MS/MS mass spectrometer comprising, in a vacuum chamber:

a first mass separation unit for selecting ions having a specific mass-to-charge ratio as precursor ions from among various species of ions;

a collision cell for dissociating the precursor ions by making the precursor ions collide with a collision-induced dissociation gas; and a second mass separation unit for selecting ions having a specific mass-to-charge ratio from among various species of product ions generated by the dissociation, wherein the collision-induced dissociation gas is supplied into the collision cell from a collision-induced dissociation gas injection port via walls forming a passage that extends within the collision cell separately from an ion injection aperture for injecting ions into the collision cell provided on a side of an injection end face of the collision cell, and is discharged from an ion exit aperture for discharging ions from the collision cell provided on a side of an exit end face of the collision cell;

wherein the walls reduce gas conductance on an injection side so as to produce, in the collision cell, a flow of the collision-induced dissociation gas having a component of flow vector in the same direction as a passage direction of the ions injected through the ion injection aperture.

2. An MS/MS mass spectrometer comprising, in a vacuum chamber:

a first mass separation unit for selecting ions having a specific mass-to-charge ratio as precursor ions from among various species of ions;

a collision cell for dissociating the precursor ions by making the precursor ions collide with a collision-induced dissociation gas; and a second mass separation unit for selecting ions having a specific mass-to-charge ratio from among various species of product ions generated by the dissociation, wherein the collision-induced dissociation gas is supplied into the collision cell from an ion injection aperture for injecting ions into the collision cell provided on a side of an injection end face of the collision cell, and is discharged from an ion exit aperture for discharging ions from the collision cell provided on a side of an exit end face of the collision cell so as to produce, in the collision cell, a flow of the collision-induced dissociation gas having a component of flow vector in the same direction as a passage direction of the ions injected through the ion injection aperture;

the side of the injection end face is provided with a plurality of injection walls respectively having ion injection apertures thereon, and the collision-induced dissociation gas is introduced between the injection walls; and respective aperture areas of the ion injection apertures and of the ion exit aperture become larger in the passage direction of the ions, and the area of the ion exit aperture is larger than the areas of each of the ion injection apertures.

* * * * *